United States Patent [19]

Pierini

[11] Patent Number: 4,631,002

[45] Date of Patent: Dec. 23, 1986

[54] ION PUMP

[75] Inventor: Marco Pierini, Genoa, Italy

[73] Assignee: Varian S.p.A., Turin, Italy

[21] Appl. No.: 525,468

[22] Filed: Aug. 22, 1983

[30] Foreign Application Priority Data

Sep. 14, 1982 [IT] Italy ..... 68093 A/82

[51] Int. Cl.[4] ..... F04F 11/00

[52] U.S. Cl. ..... 417/49; 204/298

[58] Field of Search ..... 204/298; 417/48, 49

[56] References Cited

U.S. PATENT DOCUMENTS 3,070,283 12/1962 Hall ..... 417/49

3,319,875 5/1967 Jepsen ..... 417/49

OTHER PUBLICATIONS

L. I. Maissel et al, Handbook of Thin Film Technology, McGraw-Hill Book Co., New York, 1970, 2-34 to 2-39.

*Primary Examiner*—John F. Niebling

*Assistant Examiner*—William T. Leader

*Attorney, Agent, or Firm*—Robert B. Frailey

[57] ABSTRACT

A sputter ion pump with a cathode having blades arranged radially adjacent the cylindrical hollow cells of the anode.

This arrangement increases the probability of grazing collisions useful for the formation of fast inert gas molecules, particularly argon. This improves the pumping speed and the speed stability in time.

4 Claims, 7 Drawing Figures

ION PUMP

BACKGROUND OF THE INVENTION

This invention relates to an ion pump with a cathode of improved structure, particularly for pumping inert gases.

The ion pump or "ionization" pump according to the invention is of the "ion sputter" type, also know as "Penning pump", which is an efficient means for producing very high vacuums.

Various phenomena occur in the pumping element of the sputter ion pump which cooperate to lower the residual pressure. With regard to inert gases which are not subject to chemical reaction, the formation of the vacuum is due mainly to the phenomenon of sputtering of the cathode which is made of getter material which deposits on the anode or on the walls of the pumping element, entrapping and fixing thereon the gas molecules.

However, the efficiency of removal of inert gases and particularly of argon by the known sputter ion pumps is not satisfactory. Following up the phenomenological model outlined above it is in fact necessary for the ionized gas molecule to be neutralized on the cathode and to maintain a sufficient kinetic energy to permit it to be implanted on the walls of the pumping element to be buried thereon by the sputtered material.

With the structure of the conventional cathodes, even the most advanced ones, with bars arranged in grid fashion above and below an anode with cylindrical cells, the neutralizing impact of the ionizing inert gas with retention of kinetic energy sufficient for implantation in an extremely unlikely event. Consequently, the efficiency of pumping of inert gases and particularly argon does not exceed certain limits because of the situation outlined above.

It is an object of the present invention to provide a sputter ion pump which is capable of producing a very high vacuum due to the use of a cathode of improved structure whose geometry considerably increases the probability that the ionized inert gas will hit the surface of the cathode, thus forming fast molecules capable of being implanted on the walls of the pumping element.

SUMMARY OF THE INVENTION

This and other objects and advantages of the invention, which will appear from the following description, are achieved by a sputter ion pump comprising a pumping element arranged between the pole pieces of a magnet and formed of an anode having cylindrical hollow cells arranged between the two cathodes of the getter material, characterized in that each cathode has a structure with inwardly extending blades arranged radially adjacent each of said anode cells.

DESCRIPTION OF PREFERRED EMBODIMENT

Figure 1:
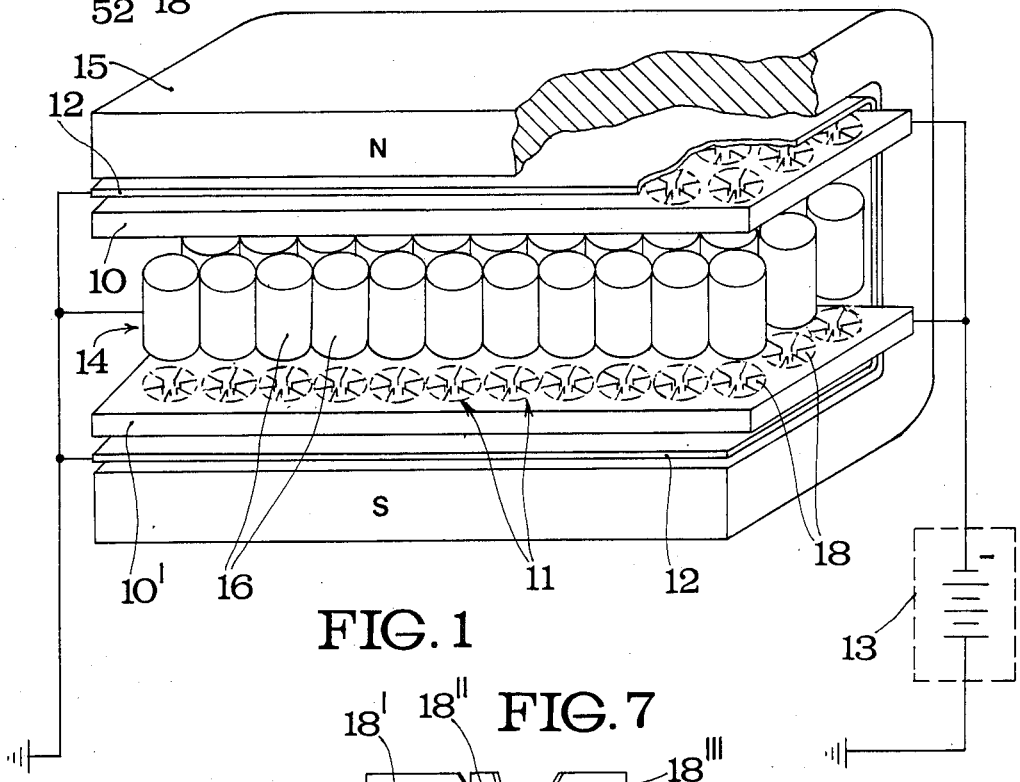
FIG. 1 is a schematic perspective view, partially in section, of an ion pump according to the invention.

FIG. 1 schematically illustrates the pumping element of a ion pump according to the invention. As shown in FIG. 1, arranged in the area between the poles of a magnet 15 are walls 12 of the ion pump and a pair of cathode plates 10, 10' of getter material, for example titanium. An anode 14 formed of a plurality of cylindrical hollow cells 16 is secured between the pair of cathode plates 10 and 10'. Electrically the configuration is that of a triode element with the two cathode plates connected to the negative pole of a potential difference source 13, and the anode and the walls of the pump connected to earth.

Each of the cathode plates 10 and 10' has a plurality of areas 11 each of which is structured with plural inwardly extending radial blades 18. Each area 11 of each cathode plate 10, 10' is located adjacent an anode cell 16. Further, the radial disposition of the inwardly extending blades within each area 11 is coaxial to its adjacent anode cell 16, and each area 11 of cathode 10 is coaxial with its corresponding area 11 of cathode 10'.

Figure 2:
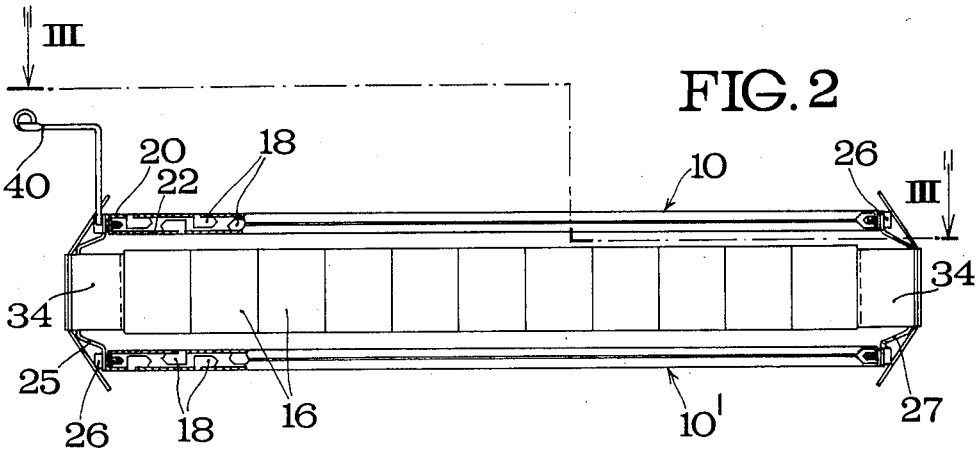
FIG. 2 is a front elevational view showing a particular embodiment of the electrodes of the pump of FIG. 1.
Figure 3:
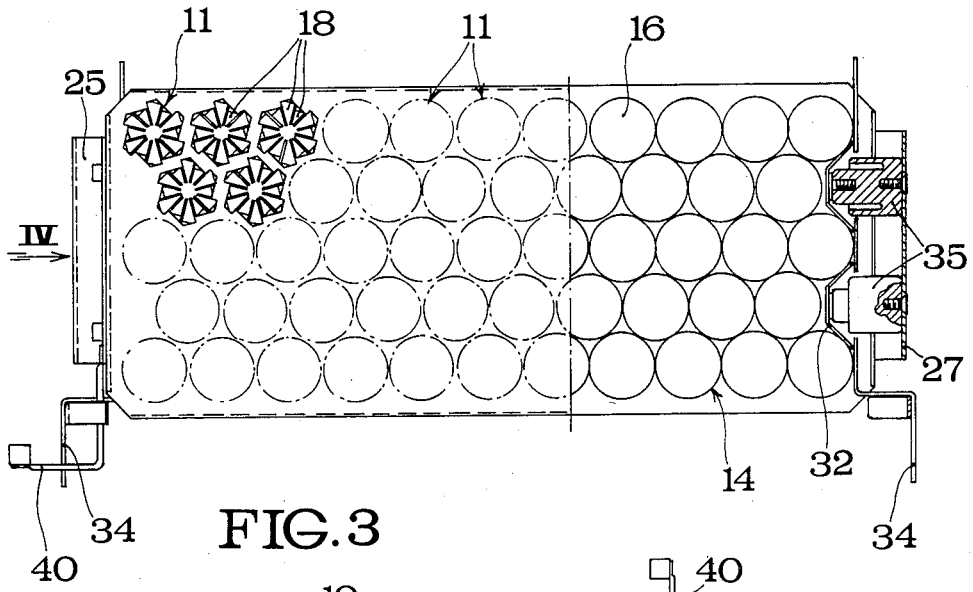
FIG. 3 is a schematic view taken on the line III—III of FIG. 2.
Figure 4:
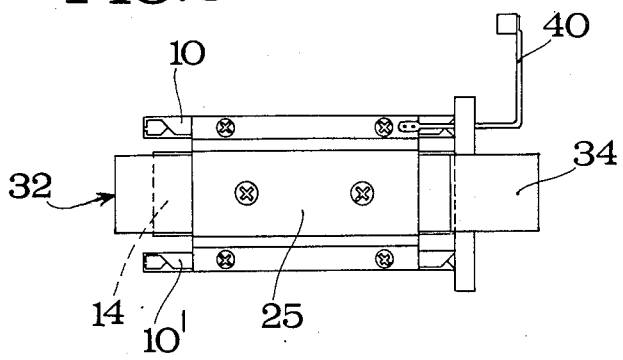
FIG. 4 is a side elevation view in the direction of the arrow IV in FIG. 3.

FIGS. 2, 3 and 4 illustrate the electrode assembly of the ion pump according to the invention in greater detail and more particularly show a preferred embodiment of the cathode. In fact, each cathode plate is formed of a pair of parallel juxtaposed plates 20 and 22 having opposing inner surfaces from which blades 18 extend inwardly.

For example, in the cathode 10 the plate 20 has a structure with blades 18 directed downwardly and the plate 22 has a structure with blades 18 directed upwardly. The blades of the two plates 20 and 22, which are arranged radially at areas 11 and centered on the axis of the anode cell 16 therebelow, are alternately intercalated. Thus, if each plate 20, 22 has six blades at each area 11, the resulting overall cathode plate will have twelve blades for each anode cell extending parallel to its axes. This configuration is shown in FIG. 3 which, however, shows only some of the areas 11 with twelve blades while the others are indicated schematically by dash-and-dot lines for reasons of simplicity. Cathode 10' preferably has the same form of structure as cathode 10.

The cathode plates 10, 10' and the anode 14 are assembled substantially by means of a connecting bracket 25 and a support bracket 27 to the upper and lower ends of which the cathode plates 10, 10' are secured by screws 26. A screen 32 with a positioning bracket 34 is placed on the head ends of the anode and mechanically connected by ceramic insulators 35 to the brackets 27 and 25. A cathode terminal 40 departs from bracket 25.

Figure 5:
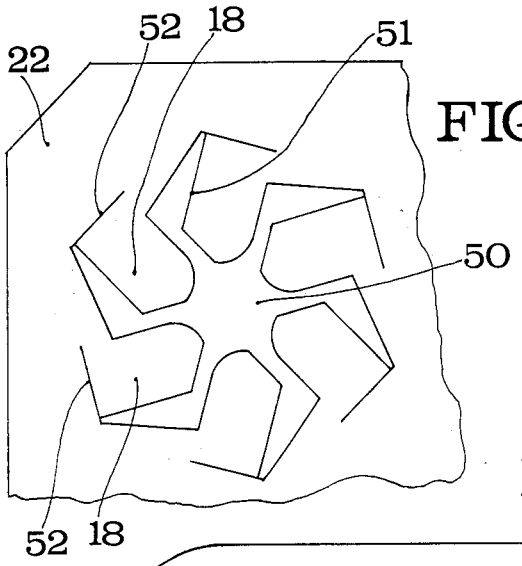
FIG. 5 is a top plan view of a detail of the cathode before the final shaping.
Figure 6:
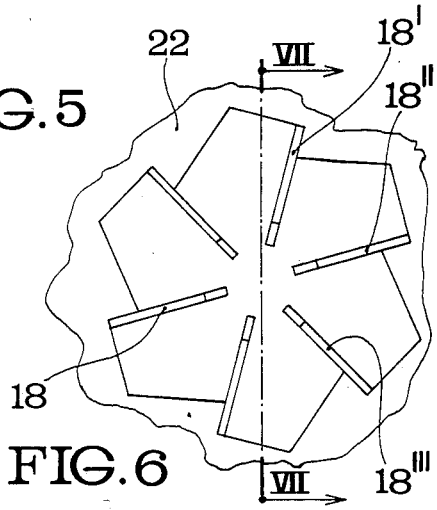
FIG. 6 is a top plan view of the same detail of the cathode after the final shaping.
Figure 7:
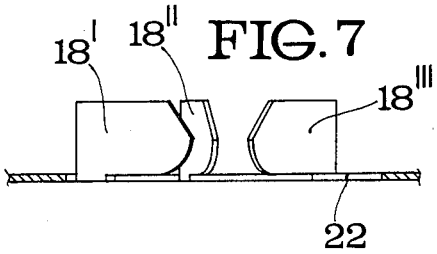
FIG. 7 is a sectional view taken on the line VII—VII of FIG. 6.

FIGS. 5, 6 and 7 show details of the blades of the plates 20, 22 which together form the cathode plates 10, 10''. FIG. 5 is a plan view showing a detail of the plate 22 before shaping the blades 18.

The following description is given only as an example for a particular process for forming the cathode with radial blades according to the invention. The flat plate 22 is cut out by removing the material in the area 50 inwardly of the star-shaped profile defined by the peripheral line 51. The portions 52 of the star are cutting lines without removal of material. FIG. 6 shows the same detail of the plate 22 after the blades 18 have been bent upwardly. Practically, the plate portion 22 is the same as that previously identified as areas 11. FIG. 7, which is a sectional view taken on the line VII—VII of FIG. 6, clearly shows the disposition of the blades 18', 18'' and 18''' after they have been bent into their final location.

The structure of the cathode plates with inwardly extending radial blades permits the pumping speed of the inert gases, particularly the heavier ones such as argon, to be increased and the speed stability in time to be improved.

Although the theoretical interpretation of the phenomena which take place in the area of magnetic confinement of the pump according to the invention does not form part of the object of the present description, some functional considerations with regard to the pumping of inert gases appear to be appropriate, especially in consideration of what has been briefly mentioned in the introductory part to this specification.

The voltage existing between the electrodes 10, 10' and 14 causes ionization of the residual gas present in the pump which has already to some extent been emptied by conventional means. The removal of the residual gas causes evaporation of the cathodes 10, 10' of getter material (titanium) by sputtering, resulting in the formation of a film on the anode which is capable of fixing (getting) the gas. The positive ions formed in the anode cells 16 are accelerated toward the cathode 10, 10' by the existing electric field.

The paths of movement of these ions are located on planes passing through the axis of the cell 16 so that the radial disposition of the blades 18 greatly increases the probability of grazing collisions of these positive ions on the cathode. The grazing collision ensures a good probability for the ion to become neutralized while maintaining a high percentage of kinetic energy. In this manner the inert gas can hit by fast molecules the wall 12 of the pump or the anode 14 to be implanted thereon and subsequently covered and buried by the film of getter material which is continuously renewed by the cathode. Whereas the geometry of the conventional cathodes substantially permitted only a few grazing collisions resulting in the formation of only a few fast molecules, the blade structure of the cathode according to the invention renders the occurrence of grazing collisions useful for the formation of fast molecules much more likely.

Although a preferred embodiment of the invention has thus been described in detail and illustrated in the accompanying drawings, it is to be understood that the invention is not limited to this precise embodiment and that numerous changes and modifications obvious to one skilled in the art may be made therein without departing from the scope of the invention as defined by the appended claims.

What is claimed is:

1. A sputter ion pump comprising a pumping element arranged between spaced pole pieces of a magnet, said pumping element including two spaced cathodes of getter material and an anode having a plurality of hollow cylindrical cells disposed between said cathodes, characterized in that each of said cathodes has a plurality of areas composed of a plurality of inwardly extending blades, each said area of each cathode being located adjacent an anode cell and being coaxial with a corresponding area in the other cathode, said inwardly extending blades of each cathode area being disposed radially relative to the axis of its adjacent anode cell and extending parallel to the axis of its adjacent anode cell.

2. A sputter ion pump comprising a pumping element arranged between spaced pole pieces of a magnet, said pumping element including walls surrounding two spaced cathodes of getter material and an anode having a plurality of cylindrical hollow cells disposed between said cathodes, characterized in that each of said cathodes has a structure formed of a plurality of blades arranged perpendicularly to a plane perpendicular to the axis of each of said cylindrical hollow cells of the anode, said blades being also arranged radially with respect to said axis of each of said cylindrical hollow cells of the anode.

3. A sputter ion pump as claimed in claim 2, wherein each of said cathodes is formed of a pair of juxtaposed parallel plates having opposing inner surfaces from which said blades extend inwardly in a radial arrangement with respect to the axes of said cylindrical hollow cells of the anode, with the blades on one plate alternating radially with the blades of the other plate.

4. A sputter ion pump comprising a pumping element arranged between spaced pole pieces of a magnet, said pumping element including two spaced cathodes of getter material and an anode having a plurality of hollow cylindrical cells disposed between said cathodes, characterized in that each of said cathodes is formed of a pair of juxtaposed parallel plates having opposing inner surfaces, each said inner surface having a plurality of areas composed of a plurality of inwardly extending blades, each said area of each cathode being located adjacent an anode cell and being coaxial with a corresponding area in the other cathode, said inwardly extending blades of each cathode area being disposed radially relative to the axis of its adjacent anode cell and extending inward toward the axis of the anode cells, the blade of one plate alternating radially with the blades of the other plate.

* * * * *